US006174639B1

(12) United States Patent
Shimizu et al.

(10) Patent No.: US 6,174,639 B1
(45) Date of Patent: Jan. 16, 2001

(54) POSITIVE CHARGING COLOR TONER

(75) Inventors: Yoshitake Shimizu; Takahiro Ishihara; Hiroshi Shimoyama; Toyotsune Inoue; Takashi Nishino; Kazuya Nagao; Kenshi Matsui; Takayuki Itakura; Norio Horikami, all of Osaka (JP)

(73) Assignee: Mita Industrial Co., Ltd., Osaka (JP)

( * ) Notice: Under 35 U.S.C. 154(b), the term of this patent shall be extended for 0 days.

(21) Appl. No.: 09/540,542

(22) Filed: Mar. 31, 2000

Related U.S. Application Data

(62) Division of application No. 09/190,014, filed on Nov. 12, 1998, now Pat. No. 6,096,467.

(30) Foreign Application Priority Data

Nov. 19, 1997 (JP) ..... 9-318756
Dec. 10, 1997 (JP) ..... 9-340288

(51) Int. Cl.[7] ..... G03G 9/097
(52) U.S. Cl. ..... 430/110; 430/111; 430/903
(58) Field of Search ..... 430/110, 111, 430/903

(56) References Cited

U.S. PATENT DOCUMENTS

| | | | | |
|---|---|---|---|---|
| 5,382,491 | * | 1/1995 | Diaz et al. | 430/110 |
| 5,482,807 | * | 1/1996 | Aoki et al. | 430/110 |
| 5,648,192 | * | 7/1997 | Kuramae et al. | 430/110 |
| 5,814,429 | * | 9/1998 | Kawakami et al. | 430/110 |
| 5,858,596 | * | 1/1999 | Tajima et al. | 430/111 |
| 6,017,671 | * | 1/2000 | Sacripante et al. | 430/110 |

FOREIGN PATENT DOCUMENTS

| | | |
|---|---|---|
| 63-220173 | 9/1988 | (JP) . |
| 63-220174 | 9/1988 | (JP) . |
| 7-66201 | 7/1995 | (JP) . |
| 8-82957 | 3/1996 | (JP) . |

* cited by examiner

*Primary Examiner*—Roland Martin
(74) *Attorney, Agent, or Firm*—Smith Gambrell & Russell, LLP

(57) ABSTRACT

Disclosed are a positive charging color toner comprising a coloring agent and a positive charging electric charge controlling material in a fixing resin, wherein the fixing rein is an urethane-modified polyester resin having an acid value of not more than 5 KOHmg/g, a hydroxyl value of not more than 9 KOHmg/g, a weight-average molecular weight of 8,000 to 120,000 and a number-average molecular weight of 2,000 to 70,000, and the positive charging electric charge controlling material is (a) a quaternary ammonium salt having a melting point of not less than 200° C., or (b) a styrene-acrylate copolymer having a trisubstituted amminio group and a glass transition temperature Tg of not less than 55° C.; and a positive charging one-component non-magnetic color toner comprising a polyester resin having an acid value of not more than 5 KOHmg/g, a hydroxyl value of not more than 9 KOHmg/g, a weight-average molecular weight of 7000 to 20,000 and a number-average molecular weight of 1,000 to 6,000, a polyolefine (releasing agent) having an acid value of not more than 10 KOHmg/g and a weight-average molecular weight of 8,000 to 15,000, a proportion of a polyolefine having a particle diameter of not less than 1.5 $\mu$m among polyolefines dispersed in the toner being within 1% in terms of the number, a coloring agent and a positive charging electric charge controlling resin.

10 Claims, 1 Drawing Sheet

POSITIVE CHARGING COLOR TONER

RELATED APPLICATION DATA

This application is a divisional of U.S. patent application Ser. No. 09/190,014, filed Nov. 12, 1998, now U.S. Pat. No. 6,096,467, which application is entirely incorporated herein by reference.

BACKGROUND OF THE INVENTION

The present invention relates to a positive charging color toner which is used in image forming apparatuses utilizing an electrophotographic process, such as electrostatic copying machine, laser beam printer and the like. The present invention includes a positive charging one-component non-magnetic color toner.

In image forming apparatuses utilizing a electrophotographic process, a more simple one-component toner, particularly a non-magnetic one-component toner, has recently been developed in place of a so-called two-component toner using a magnetic carrier and a toner.

In a developing method using the non-magnetic one-component toner, as shown in FIG. 1, first, a toner 1 is charged by frictional charging between a developing roller 2 and a control blade 3, and then adhered on the surface of the developing roller 2 by an image force effect, thereby to form a thin layer of the charged toner 1.

Then, when this thin layer is contacted with an electrostatic latent image on a photoconductor drum 4, the toner 1 in the thin film is transferred to the photoconductor drum 4 according to a potential of each portion of the electrostatic latent image and the electrostatic latent image is developed into a toner image. That is, a so-called reversal development type contact developing method is employed.

As described above, since the toner 1 is circulated in a developing device 8 while being contacting with the control blade 3 and photoconductor drum 4, high durability (strength), which makes it possible to hardly cause deterioration due to heat or pressure generated by friction with the developing roller 2, is required. It is essential to prevent fusion between toners 1 due to heat or pressure generated by friction, or fusion of the toner 1 to the control blade 3 so as not to lower image formation, particularly.

In the latest image forming apparatus, since the requirements such as high speed and low cost have been increased more and more, there has been studied to develop an image forming apparatus wherein conditions of friction to the toner 1 are more severe, for example, a moderate-speed image forming apparatus, or a recycle type image forming apparatus wherein, after the toner 1 was transferred on the photoconductor drum 4, the toner recovered without being transferred on a paper is utilized by transferring to the developing device 8 again. Excellent durability capable of sufficiently coping in these image forming apparatuses is required to the toner 1.

On the other hand, regarding the above toner image to be formed by the development, it has rapidly been developed to change a conventional monochromic development into a full-color development capable of forming an image by registration of toners of yellow, magenta and cyane. According to the full-color development, a multi-color image can be obtained by subjecting a multi-color original to color separation, exposing the multi-color original to light, repeating this step plural times using the above toners of three colors, followed by registration of toner images.

Accordingly, in the full-color development requiring plural developments and registration of a toner layer having a different color onto the same recording medium as a fixing step, a toner having excellent transparency and color mixing property is desired.

Furthermore, with the increase of requirements such as high speed and long life to the above image forming apparatuses as well as requirements of power saving, the low-temperature fixing temperature is apt to be reduced to respond to the requirements and a toner having good fixing property at a lower temperature is required.

Therefore, a polyester resin, which is superior in these characteristics, has been studied as a fixing resin of the toner.

By the way, as the developing method using the non-magnetic one-component toner, the above-described reversal development type contact developing method used in a plain paper facsimile device, a laser printer or the like is popular.

In such a developing method, it is necessary to use a toner and a photoconductor of the same charging type. However, when charging a negatively charging type photoconductor used in combination with a negatively charging type toner, which is often used at present, a large amount of ozone is evolved from a charger and, therefore, it becomes necessary to take a measure against leakage of this ozone outside, resulting in a complicated device. Furthermore, the photoconductor is deteriorated by ozone, thereby reducing the life of the photoconductor drum 4.

Therefore, in the above reversal development type contact developing method, a combination of a positive charging photoconductor and a positive charging toner is required.

However, since the above polyester resin is a polycondensate of a polybasic acid and a polyhydric alcohol, its acid value becomes higher when a lot of unreacted carboxyl groups are present at the polymer terminal and it becomes difficult to charge positively. It has also been known that the polyester resin is insufficient in environmental resistance because an influence of temperature and humidity is liable to be exerted.

Therefore, there have hitherto been suggested various color toners wherein a polyester resin having a specific acid value and/or a specific hydroxyl value is used as the fixing resin to stable the positively charging property of the toner and to improve the environmental resistance (Japanese Laid-open Patent Publication Nos. 220173/1988 and 220174/1988 and Japanese Examined Patent Publication No. 66201/1995).

However, all of toners using a polyester resin having a predetermined acid value and/or a specific hydroxyl value disclosed in the above publications are insufficient in stable positively charging property. The carboxyl group and hydroxyl group contained in the polyester resin are liable to absorb water because they are hydrophilic. Particularly, preferable uniform charge amount can not be obtained under severe conditions of high-temperature/high-humidity and the image is deteriorated.

It is suggested to contain a positive charging electric charge controlling material such as nigrosine dye, quaternary ammonium salt or polymer having a quaternary ammonium salt group (electric charge controlling resin) in the specific polyester resin disclosed in the above publications in accordance with a commonly used technique, thereby to impart good positively charging property to the toner.

However, the nigrosine dye and quaternary ammonium salt are liable to be thermally decomposed in the kneading process in the production of the toner, and can not impart sufficient positively charging property to the toner.

Furthermore, the electric charge controlling resin is liable to cause a problem that the transparency and positively charging property of the toner are lowered if the compatibility with the fixing resin is not sufficient.

Furthermore, all of the above publications do not teach or suggest a means for reducing deterioration of the toner due to friction with the developing roller 2. Therefore, in the toner disclosed in these publications, the durability (strength) to the above-described moderate-speed image forming apparatus has still to be sufficient.

When the polyester resin is used as the fixing resin, good low-temperature fixing property is obtained. On the other hand, since the offset resistance is insufficient, there was a problem of a so-called offset phenomenon, that is, when the surface of a heating roller is contacted with the surface of a toner image by a heat roller fixing manner, a toner is adhered on the heating roller, thereby to transfer the toner to the following transfer paper.

Japanese Laid-open Patent Publication No. 82957/1996 discloses a color toner comprising a polyester resin having an acid value of not more than 5 KOHmg/g and waxes having an acid value of not more than 20 KOHmg/g as a releasing agent (anti-offset agent).

In the toner with the construction of the above publication, by defining the acid value of the polyester resin and waxes, uniform positively charging property is imparted to the toner and, at the same time, the offset resistance is improved.

However, since the wax is contained in the toner, the transparency and positively charging property of the toner are likely to be lowered if the wax is not sufficiently dispersed in the toner.

With the increase of the number of copies, the toner is gradually accumulated and fused on the surface of the photoconductor drum, thereby to cause filming.

Furthermore, all of the above publications do not teach or suggest any means for reducing wear of the photoconductor drum.

That is, it is an object of the present invention to provide a positive charging color toner having excellent positively charging property and environmental resistance as well as high durability without adversely affecting low-temperature fixing property and transparency of a polyester resin.

It is another object of the present invention to provide a positive charging one-component non-magnetic color toner which is superior in transparency and positively charging property, and which can reduce wear of a photoconductor drum and can prevent filming, without adversely affecting low-temperature fixing property of a polyester.

SUMMARY OF THE INVENTION

The present inventors have studied intensively in order to accomplish the above object. As a result, they have found a new positive charging color toner. That is, the present invention includes the following inventions.

(1) A positive charging color toner comprising a coloring agent and a positive charging electric charge controlling material in a fixing resin, wherein the fixing rein is an urethane-modified polyester resin having an acid value of not more than 5 KOHmg/g, a hydroxyl value of not more than 9 KOHmg/g, a weight-average molecular weight of 8,000 to 120,000 and a number-average molecular weight of 2,000 to 70,000, and the positive charging electric charge controlling material is (a) a quaternary ammonium salt having a melting point of not less than 200° C., or (b) a styrene-acrylate copolymer having a trisubstituted ammonio group and a glass transition temperature Tg of not less than 55° C.

(2) A positive charging one-component non-magnetic color toner comprising at least a fixing resin, a coloring agent, a releasing agent and a positive charging electric charge controlling resin, wherein the fixing rein is made of a polyester resin having an acid value of not more than 5 KOHmg/g, a hydroxyl value of not more than 9 KOHmg/g, a weight-average molecular weight of 7000 to 20,000 and a number-average molecular weight of 1,000 to 6,000, and the releasing agent is a polyolefine having an acid value of not more than 10 KOHmg/g and a weight-average molecular weight of 8,000 to 15,000, a proportion of a polyolefine having a particle diameter of not less than 1.5 $\mu$m among polyolefines dispersed in the toner being within 1% in terms of the number.

In the present invention, the invention of the above term (1) has the following features.

In the present invention, since a polyester resin having an acid value of not more than 5 KOHmg/g is used as the fixing resin, the toner can be positively charged, efficiently. In the present invention, since the above polyester resin is urethane-modified by reacting a hydroxyl group of the polyester resin with isocyanate, it has a numerical value (not more than 9 KOHmg/g) lower than the hydroxyl value of the polyester resin disclosed in the above publication.

Accordingly, the urethane-modified polyester resin used in the present invention is superior in environmental resistance under not only a normal service environment but also severe conditions of high-temperature/high-humidity because the hydroxyl value is small, in addition to the acid value.

Since the urethane-modified polyester resin is more strong and tough than a normal polyester resin by imparting the elasticity of an urethane group itself, the durability of the toner and life of the toner can be improved.

The urethane-modified polyester resin has a weight-average molecular weight of 8,000 to 12,000 and a number-average molecular weight of 2,000 to 7,000 and, therefore, it has a suitable hardness. Accordingly, when using a toner obtained from the polyester resin, low-temperature fixing property is excellent and fusion of the toner onto the control blade 3 can be prevented.

In the present invention, by using a quaternary ammonium salt having a melting point of not less than 200° C. as a positive charging electric charge controlling material, there is not a fear that the quaternary ammonium salt in the kneading process in the production of the toner, thereby to adversely affect a function of imparting the positively charging property.

In place of the quaternary ammonium salt having the above predetermined melting point, an electric charge controlling resin having a predetermined glass transition temperature can be used. The toner using such an electric charge controlling resin has good compatibility with the urethane-modified polyester resin and, therefore, phase separation with the fixing resin does not arise. Moreover, agglomeration of the pigment hardly arises and, therefore, the transparency and positively charging property are excellent.

Next, the invention of the above term (2) in the present invention has the following features.

Since the polyester resin used in the present invention has a weight-average molecular weight of 7,000 to 20,000 and a number-average molecular weight of 1,000 to 6,000, it is comparatively flexible. Therefore, when using the toner obtained from the polyester resin, wear of the photoconductor drum can be reduced and the toner has a proper hardness enough to prevent fusion of the toner onto the photoconductor drum. Furthermore, the offset resistance is also improved.

In the present invention, by using a polyolefine having the predetermined acid value, weight-average molecular weight and particle diameter as the releasing agent, the offset resistance as the conventional effect recognized by adding the releasing agent to the toner is improved and, at the same time, an improvement in transparency and positively charging property, a prevention of filming and a reduction in wear of the photoconductor drum are performed.

In the present invention, when using the above specific polyolefine in the amount of 0.2 to 5 parts by weight based on 100 parts by weight of the polyester resin, filming is prevented without adversely affecting the transparency and uniform positively charging property, and excellent effect of reducing wear of the photoconductor drum is exerted.

EXPLANATION OF REFERENCE SYMBOLS

5: hopper for feeding toner

6: agitator for stirring toner

7: roller for feeding toner

8: developing device

DETAILS OF THE INVENTION

Figure 1:
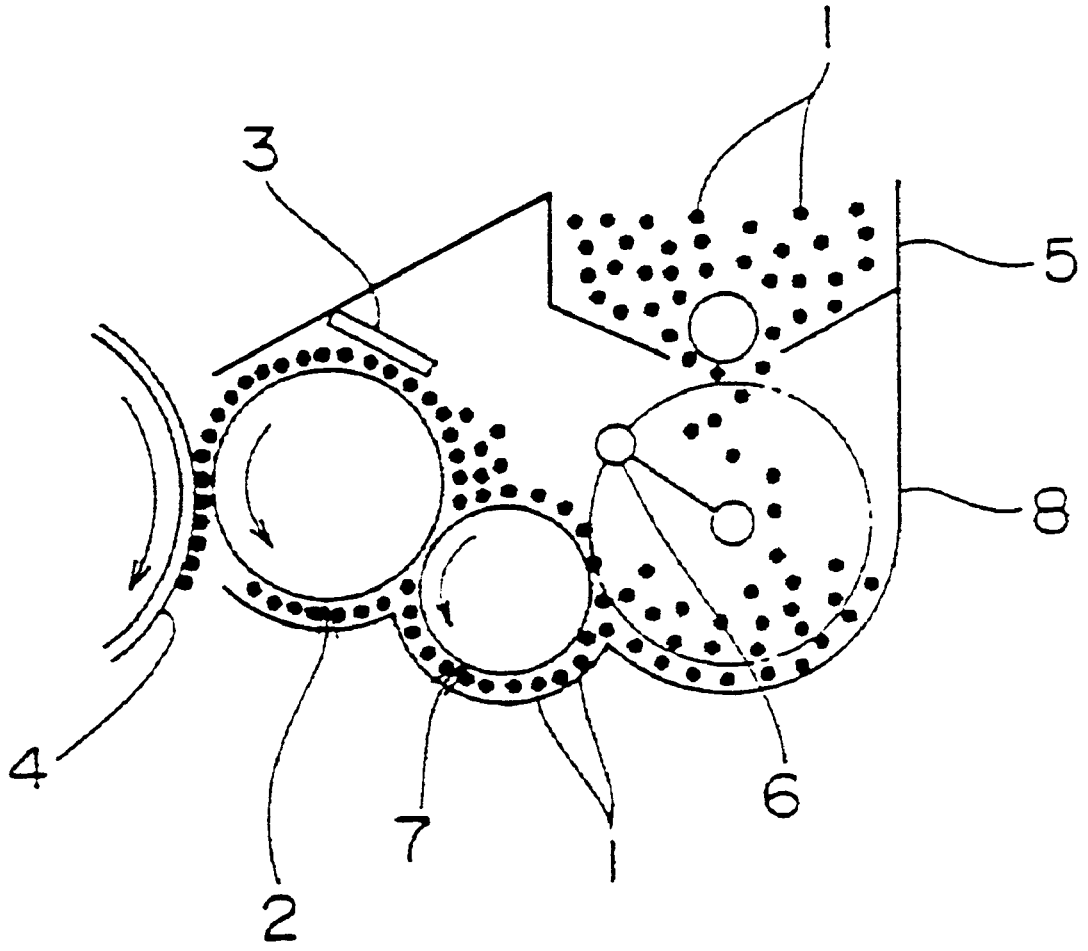
FIG. 1 is a schematic diagram showing a non-magnetic one-component contact developing method.

In the present invention, the positive charging color toner of the above term (1) is constructed by dispersing at least a positive charging electric charge controlling material and a coloring agent in an urethane-modified polyester resin as the fixing resin.

The urethane-modified polyester resin can be easily produced according to a commonly used production method which is employed in the production of the polyurethane resin. That is, as shown in the following reaction scheme (I), it is produced by reacting a terminal hydroxyl group of the polyester resin with diisocyanate ($R^1$—N=C=O) described hereinafter to form an urethane. In that case, when tertiary amines, phosphines or organometallic compounds (e.g. aluminum, tin, etc.) of Lewis acids are added as a catalyst in the reaction system, the reaction efficiently proceeds.

$$\text{—OH} + R^1\text{—N=C=O} \rightarrow \text{—O—CO—NH—}R^1 \qquad \text{(I)}$$

As the polyester resin used in the above reaction scheme (I), various saturated or unsaturated polyester resins having an ester bond in the main chain can be used. Particularly, the following four kinds of polyester resins are preferably used.

(1) Polyester resin obtained by polycondensing a glycol represented by the general formula (1):

(1)

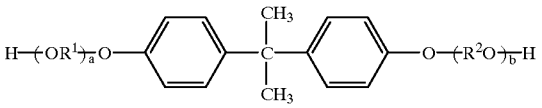

wherein $R^1$ and $R^2$ are the same or different and represent an ethylene group or a propylene group; and a and b respectively represent an integer of not less than 1, with dicarboxylic acids having two or more valences, or esters thereof.

(2) Polyester resin obtained by polycondensing a compound represented by the general formula (2):

(2)

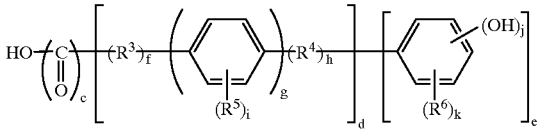

wherein $R^3$ represents an alkylidene group having 1 to 6 carbon atoms or an alkylene oxide group having 1 to 3 carbon atoms; $R^4$ represents an alkylidene group having 1 to 6 carbon atoms, an oxygen atom, a sulfur atom, a carbonyl group, a sulfinyl group or a sulfonyl group; $R^5$ and $R^6$ are the same or different and represent a hydrogen atom, a halogen atom or an alkyl group having 1 to 4 carbon atoms; c and d respectively represent an integer of 0 or 1; e represents an integer of 1 to 3, provided c and d do not represent 0, simultaneously; f, g and h are the same or different and represent an integer of 0 or 1; i represents an integer of 1 to 4; j represents an integer of 0 to 4; and k represents an integer of 1 to 4, with polyhydric alcohols, and dicarboxylic acids or esters thereof.

(3) Polyester resin obtained by reacting polyhydric alcohols containing a glycol represented by the general formula (3):

(3)

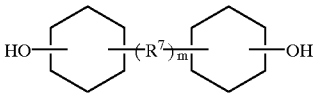

wherein $R^7$ represents an alkylene group having 1 to 5 carbon atoms; and m represents an integer of 0 or 1, with dicarboxylic acids or esters thereof.

(4) Polyester resin obtained by reacting polyhydric alcohols containing a glycol represented by the general formula (4):

(4)

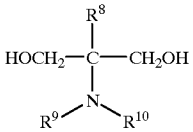

wherein $R^8$, $R^9$ and $R^{10}$ are the same or different and represents a hydrogen atom or an alkyl group having 1 to 4 carbon atoms, with dicarboxylic acids or esters thereof.

Specific examples of the glycol represented by the general formula (1) include polyoxypropylene(2,2)-2,2-bis(4-oxyphenyl)propane, polyoxypropylene(3,3)-2,2-bis(4-oxyphenyl)propane, polyoxyethylene(2,0)-2,2-bis(4-oxyphenyl)propane, polyoxypropylene(2)-polyoxyethylene (2)-2,2-bis(4-oxyphenyl)propane and the like, but are not limited thereto.

Specific examples of the compound represented by the general formula (2) include diphenolic acid, o-oxybenzoic acid, m-oxybenzoic acid, p-oxybenzoic acid, 2,4-dioxybenzoic acid, o-oxyphenylacetic acid, m-oxyphenylacetic acid, p-oxyphenylacetic acid, phenolphthalein, p-oxybenzyl alcohol, oxyethylene-p,p'-bisphenol, oxypropylene-bis(4-oxyphenyl)thioether, oxybutylene-bis(4-oxyphenyl)ketone and the like.

Specific examples of the glycol represented by the general formula (3) include 2,2-bis(4-oxycyclohexyl)propane, 2,2-bis(4-oxycyclohexyl)ether, 2,2-bis(4-oxycyclohexyl) ketone, 2,2-bis(4-oxycyclohexyl)sulfon and the like.

Examples of the dicarboxylic acid to be reacted with the glycols of the general formulas (1) to (4) or esters thereof include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, liloleic acid and dimers thereof, and lower alkyl esters thereof.

Examples of the carboxylic acid having three or more valences to be reacted with the glycol represented by the general formula (1) include 1,2,4-benzenetricarboxylic acid, 1,3,5-benzenetricarboxylic acid, 1,2,4-cyclohexanetricarboxylic acid, 1,3,5-cyclohexanetricarboxylic acid, 2,4,7-naphthalenetricarboxylic acid, 1,2,4-naphthalenetricarboxylic acid, 1,2,5-hexanetricarboxylic acid, 1,3-dicarboxy-2-methylcarboxypropene and the like.

As the above diisocyanate ($R^1$—N═C═O), there can be used known diisocyanates used in the production of the polyurethane, and examples thereof include 2,4-tolylene diisocyanate, hexamethylene diisocyanate, toluene diisocyanate, xylylene diisocyanate, hexamethylene diisocyanate, naphthalene diisocyanate, dimethyl-diphenyl diisocyanate, dimethoxy-diphenyl diisocyanate and the like.

Regarding the characteristic value of the urethane-modified polyester resin thus obtained, the acid value is not more than 5 KOHmg/g and the hydroxyl value is not more than 9 KOHmg/g, as described above.

The acid value of the urethane-modified polyester resin is an index which indicates the content of free acid in the resin, and is obtained by representing the amount of potassium hydroxide required to neutralize the free acid by using the number of mg based on 1 g of the polyester resin.

The hydroxyl value of the urethane-modified polyester resin is an index which indicates the content of a hydroxyl group in the resin, and is obtained by representing the amount of potassium hydroxide required to neutralize acetic acid used in acetylation by using the number of mg based on 1 g of a sample.

When the acid value of the urethane-modified polyester resin exceeds 5 KOHmg/g, it becomes impossible to positively charge the color toner, efficiently, even if the positive charging electric charge controlling material is mixed.

When the hydroxyl value of the urethane-modified polyester resin exceeds 9 KOHmg/g, the environmental resistance of the electrophotographic toner is lowered as described above and the charging characteristics become unstable by a variation in temperature and humidity in the service environment.

To obtain good positively charging property under severe conditions of high-temperature/high-humidity or low-temperature/low-humidity, it is suitable to use an urethane-modified polyester resin wherein the sum of the acid value and hydroxyl value is normally not more than 12 KOHmg/g, and preferably from 0 to 8 KOHmg/g.

The acid value is preferably within a range from 0 to 4 KOHmg/g, and more preferably from 0 to 3 KOHmg/g.

The hydroxyl value is preferably within a range from 0 to 7 KOHmg/g, and more preferably from 0 to 5 KOHmg/g.

To adjust the acid value of the urethane-modified polyester resin within the above range, the acid group in the polyester resin may be neutralized with a suitable substance.

Specifically, to esterify a carboxylate group, which is mainly present in the terminal of the polyester resin, the carboxylate group may be reacted with a monovalent acid or a halide of the acid. Furthermore, the hydroxyl group may be alkylated by the reaction such as epoxidation, amidation or the like.

In the present invention, the hydroxyl group, which is present in the terminal of the polyester resin is neutralized (formation of urethane group) by using the above-described diisocyanate. The hydroxyl value of the polyester resin may also be adjusted within the above range by neutralizing the hydroxyl group by esterification or amidation to such a degree that the durability of the resulting toner is not adversely affected.

Taking an improvement in low-temperature fixing property of the urethane-modified polyester resin and an improvement in prevention of fusion of the toner onto the control blade into consideration, the molecular weight of the polyester resin may be within a range from 8,000 to 120,000, and preferably from 10,000 to 100,000, in terms of the weight-average molecular weight. Also, the molecular weight of the polyester resin may be within a range from 2,000 to 7,000, and preferably from 3,000 to 6,000, in terms of the number-average molecular weight.

When the weight-average molecular weight and number-average molecular weight of the polyester resin exceeds the above range, the resulting toner becomes hard and the low-temperature fixing property of the toner is lowered. On the other hand, when the weight-average molecular weight and number-average molecular weight of the polyester resin are smaller than the above range, the resulting toner is soft and, therefore, the toner is liable to be fused on the control blade and good image can not be formed.

The positive charging electric charge controlling material to be mixed to impart good positively charging property, together with the above urethane-modified polyester resin, includes quaternary ammonium salt or polymer substance having a functional group capable of imparting the positively charging property to the toner at the side chain (electric charge controlling resin).

The quaternary ammonium salt is not specifically limited as far as it satisfies the following points (1) to (4).

(1) Taking use its employment in the color toner into consideration, it is colorless or shows a light color close to colorless.

(2) It is hardly decomposed during the kneading process in the production of the toner, and is superior in thermal stability and exerts good positively charging control function.

(3) It hardly absorbs water even under severe conditions such as high-temperature/high-humidity, and is superior in environmental resistance and is not likely to lower the positively charging property of the toner.

(4) It is superior in compatibility with the fixing resin.

If the characteristics of the above term (2) are not satisfied, the effect obtained by adding the electric charge controlling agent (positively charging control function) is not exerted and good positively charging property can not be imparted to the toner. Accordingly, as the quaternary ammonium salt used in the present invention, those having a melting point of not less than 200° C., which is not decomposed at the set temperature at the time of kneading, are preferred. Specific examples thereof include a quaternary ammonium salt represented by the general formula (5):

(5)

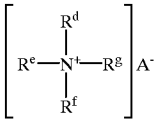

wherein $R^d$ to $R^g$ are the same or different and represent an alkyl group such as methyl group, ethyl group, normal propyl group, isopropyl group, normal butyl group, isobutyl group, tertiary butyl group, pentyl group or hexyl group; and $A^-$ represents a molybdate ion, a phosphorous molybdate ion, a chromium molybdate ion, a phosphorous tungstate, a tungstate silicide ion, an antimonate ion, a bismuthate ion, a chlorine ion, a bromine ion, an iodine ion, a nitrate ion, a sulfate ion, a perchlorate ion, a periodate ion, a benzoate ion, a naphtholsulfonate ion, a benzenesulfonate ion, a toluenesulfonate ion, a xylenesulfonate ion, a tetraphenylboron ion, a tetrafluoroboron ion, a tetrafluorophosphorous ion or a hexafluorophosphorous ion.

For example, the followings are listed.

Manufactured by Clariant Corporation

[VP2036] (melting point: 200° C.)

[VP2038] (melting point: 215° C.)

Manufactured by Hodogaya Chemical Co., Ltd.

[TP302] (melting point: 215° C.)

[TP415] (melting point: 204° C.)

[TP4040] (melting point: 209° C.)

Manufactured by Nippon Garlit Co., Ltd.

[A-902] (melting point: 210° C.)

On the other hand, the functional group capable of imparting positively charging property to the toner in the electric charge controlling resin includes various groups, but a trisubstituted ammonio group is particularly preferred. Among them, a trialkylammonio group represented by the general formula (6):

(6)

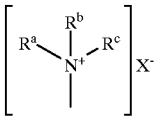

[wherein $R^a$, $R^b$ and $R^c$ are the same or different and represent an alkyl group such as methyl group, ethyl group, normal propyl group, isopropyl group, normal butyl group, isobutyl group, tertiary butyl group, pentyl group or hexyl group; and $X^-$ represents a molybdate ion, a phosphorous molybdate ion, a chromium molybdate ion, a phosphorous tungstate, a tungstate silicide ion, an antimonate ion, a bismuthate ion, a chlorine ion, a bromine ion, an iodine ion, a nitrate ion, a sulfate ion, a perchlorate ion, a periodate ion, a benzoate ion, a naphtholsulfonate ion, a benzenesulfonate ion, a toluenesulfonate ion, a xylenesulfonate ion, a tetraphenylboron ion, a tetrafluoroboron ion, a tetrafluorophosphorous ion or a hexafluorophosphorous ion] is more preferred because of its excellent function of imparting the positively charging property.

As the main chain of the electric charge controlling resin, various polymer chains can be employed. Since the compatibility with the polyester resin as the fixing resin is particularly important in view of the transparency and positively charging property, it is preferred to use a polymer main chain having good compatibility with the above polyester resin.

Examples of the polymer main chain include styrene-acrylate resins such as styrene-acrylate copolymer, styrene-methacrylate copolymer and the like. In case that the styrene-acrylate resin is a main chain, the functional group is preferably substituted on the ester portion of the acrylate.

To further improve the compatibility with the urethane-modified polyester resin and the dispersion in the toner, it is important to adjust the glass transition temperature Tg of the electric charge controlling resin within a suitable range. That is, as the electric charge controlling resin used in the present invention, a styrene-acrylate resin having a trisubstituted ammonio group and a glass transition temperature Tg of not less than 55° C., preferably within a range from 60 to 80° C., is preferred.

The term "glass transition temperature Tg" used herein refers to a value measured by using a differential scanning calorimetry (DSC) of a TAS-200 thermal analysis system.

When the glass transition temperature of the electric charge controlling resin is smaller than 55° C., the compatibility with the fixing resin is lowered and, therefore, the fixing resin and electric charge controlling resin cause phase separation during the kneading process in the production of the toner and, at the same time, agglomeration of a pigment used as the coloring agent is likely to occur. Accordingly, the transparency and positively charging property of the toner are lowered and a toner with good quality is not prepared and, therefore, fusion of the toner onto the control blade is likely to occur.

Other characteristics of the electric charge controlling resin are not specifically limited, but the molecular weight is from about 8,000 to 18,000, and preferably from about 10,000 to 15,000, in terms of the weight-average molecular weight.

The amount of the electric charge controlling material is not specifically limited, but is normally from 0.5 to 20 parts by weight, and preferably from 3 to 12 parts by weight, based on 100 parts by weight of the urethane-modified polyester resin.

When the amount of the electric charge controlling material exceeds 20 parts by weight, the compatibility with the urethane-modified polyester resin becomes inferior and the transparency of the toner is likely to be lowered. On the other hand, when the amount of the electric charge controlling material is smaller than 0.5 parts by weight, there is a fear that the effect of imparting the positively charging property due to mixing of the electric charge controlling material is not sufficiently obtained.

Examples of the coloring agent includes various coloring pigments and loading pigments, but the followings can be preferably used.

Examples of the coloring agent for black toner include various carbon blacks produced by thermal black method, acetylene black method, channel black method and furnace black method. Specific examples thereof include "Carbon Black #44" (trade name) manufactured by MITSUBISHI CHEMICAL CORPORATION and "PRINTEX L" (trade name) manufactured by Degussa AG.

Examples of the yellow coloring agent include azo pigments described in the color index (C.I.) such as Pigment Yellow (P.Y.) 1, Pigment Yellow 2, Pigment Yellow 3, Pigment Yellow 4, Pigment Yellow 5, Pigment Yellow 12, Pigment Yellow 13, Pigment Yellow 14, Pigment Yellow 15, Pigment Yellow 17, Pigment Yellow 24, Pigment Yellow 55, Pigment Yellow 61, Pigment Yellow 62, Pigment Yellow 61:1, Pigment Yellow 65, Pigment Yellow 73, Pigment Yellow 74, Pigment Yellow 81, Pigment Yellow 83, Pigment Yellow 87, Pigment Yellow 93, Pigment Yellow 94, Pigment Yellow 95, Pigment Yellow 97, Pigment Yellow 98, Pigment Yellow 109, Pigment Yellow 110, Pigment Yellow 128, Pigment Yellow 154, Pigment Yellow 168, Pigment Yellow 169, Pigment Yellow 180; and inorganic pigments such as yellow iron oxide, loess and the like. Examples of the dye include C.I. Solvent Yellow 2, C.I. Solvent Yellow 6, C.I. Solvent Yellow 14, C.I. Solvent Yellow 15, C.I. Solvent Yellow 16, C.I. Solvent Yellow 19, C.I. Solvent Yellow 21 and the like.

Examples of the magenta coloring agent include those described in the color index (C.I.), such as C.I. Pigment Red (P.R.) 81, C.I. Pigment Red 122, C.I. Pigment Red 57, C.I. Pigment Red 84, C.I. Pigment Red 49, C.I. Solvent Red 49, C.I. Solvent Red 19, C.I. Solvent Red 52, C.I. Basic Red 10, C.I. Disperse Red 15 and the like.

Examples of the cyane coloring agent include those described in the color index (C.I.), such as C.I. Pigment Blue (P.B.) 15, C.I. Pigment Blue 16, C.I. Pigment Blue 68, C.I. Pigment Blue 55, C.I. Solvent Blue 70, C.I. Direct Blue 25 and the like.

The amount of these coloring agents may be within a range from 2 to 10 parts by weight, and preferably from 3 to 8 parts by weight, based on 100 parts by weight of the urethane-modified polyester resin.

To the positive charging color toner, conventionally known various additives may be mixed, in addition to the above respective components. Examples thereof include releasing agents (anti-offset agents).

Examples of the releasing agent include aliphatic hydrocarbons, aliphatic metal salts, higher fatty acids, fatty esters or partially saponified substances thereof, silicone oil, various waxes and the like. Among them, aliphatic hydrocarbons having a weight-average molecular weight of about 8,000 to 15,000 are preferred. Specifically, low-molecular weight polyethylene, low-molecular weight polypropylene paraffin wax and low-molecular weight olefin polymer comprising an olefin unit having 4 or more carbon atoms are preferred. These releasing agents can be used alone or in combination thereof.

The amount of the releasing agent may be from 0.1 to 7 parts by weight, and preferably from 0.2 to 5 parts by weight, based on 100 parts by weight of the urethane-modified polyester resin.

When the amount of the releasing agent exceeds the above range, the transparency and positively charging property are lowered. On the other hand, when the amount of the releasing agent is smaller than the above range, wear of the photoconductor drum occurs and the offset resistance can not be expected.

The positive charging color toner of the present invention is produced by homogeneously premixing the above respective components using a dry blender, Henshel mixer, ball mill or the like to obtain a mixture; uniformly melting and kneading the resulting mixture using a kneading device such as single or twin screw kneading extruder; cooling and grinding the resulting kneaded product; and optionally classifying the ground particles.

The particle diameter of the toner thus obtained is appropriately adjusted according to the service purpose, but may be within a range from about 5 to 12 $\mu$m, and preferably from about 6 to 10 $\mu$m, for the purpose of realizing high image quality of the formed image.

To the color toner particles, conventionally known surface treating agents such as inorganic fine particles, fluororesin fine particles and the like can also be added to improve the fluidity and charging characteristics. Particularly, there can preferably be used silica surface treating agents containing hydrophobic or hydrophilic silica fine particles, for example, anhydrous silica and colloidal silica in the form of ultrafine particles.

The amount of the surface treating agent to be added may be the same as that of the prior art. Specifically, the amount may be preferably about 0.1 to 2.0 parts by weight based on 100 parts by weight of the toner particles.

The construction of the positive charging color toner of the present invention is employed in the color toner for non-magnetic one-component system, as described above, but can be applied as the other developing agent.

For example, when using as a two-component color toner, the color toner with the above construction may be used in combination with a conventionally known magnetic carrier.

In the present invention, the positive charging one-component non-magnetic color toner of the above term (2) is constructed by dispersing at least a positive charging electric charge controlling material, a releasing agent and a coloring agent in a polyester resin as the fixing resin.

As the polyester resin, various saturated or unsaturated polyester resins having an ester bond in the main chain can be used. Particularly, four kinds of polyester resins of the above terms (1), (2), (3) or (4) are preferably used.

Regarding the characteristic value of the polyester resin thus obtained, the acid value is not more than 5 KOHmg/g and the hydroxyl value is not more than 9 KOHmg/g, as described above. The acid value and hydroxyl value have the same meanings as those explained in the case of the urethane type polyester. When the acid value of the polyester resin exceeds 5 KOHmg/g, it becomes impossible to positively charge the color toner, efficiently, even if the positive charging electric charge controlling material is mixed. When the hydroxyl value of the polyester resin exceeds 9 KOHmg/g, the environmental resistance of the electrophotographic toner is lowered as described above and the charging characteristics become unstable by a variation in temperature and humidity in the service environment, as described above. The acid value is preferably within a range from 0 to 4 KOHmg/g, and more preferably from 0 to 3 KOHmg/g. On the other hand, the hydroxyl value is preferably within a range from 0 to 7 KOHmg/g, and more preferably from 0 to 5 KOHmg/g.

To adjust the acid value of the polyester resin within the above range, the acid group and hydroxyl group in the polyester resin may be neutralized with a suitable substance.

Specifically, to esterify a carboxylate group or a hydroxyl group, which is mainly present in the terminal of the polyester resin, the carboxylate group may be reacted with monohydric alcohols, whereas, the hydroxyl group may be reacted with an acid or a halide of the acid. Furthermore, the hydroxyl group or hydroxyl group may be alkylated by the reaction such as epoxidation, amidation or the like.

Taking an improvement in reduction of wear of the photoconductor drum and an improvement in prevention of fusion of the toner onto the control blade into consideration, the molecular weight of the polyester resin may be within a range from 7,000 to 200,000, and preferably from 8,000 to 17,000, in terms of the weight-average molecular weight. Also, the molecular weight of the polyester resin may be within a range from 1,000 to 6,000, and preferably from 2,000 to 5,000, in terms of the number-average molecular weight.

When the weight-average molecular weight and number-average molecular weight of the polyester resin exceeds the above range, the resulting toner becomes hard and wear of the photoconductor drum can not be reduced. On the other hand, when the weight-average molecular weight and number-average molecular weight of the polyester resin are smaller than the above range, the resulting toner is soft and, therefore, the toner is liable to be fused on the control blade and good image can not be formed. Furthermore, the offset resistance becomes insufficient and an offset phenomenon is liable to arise.

In the present invention, the present inventors have found that it is insufficient to use only a polyolefine whose acid value is defined as the releasing agent in order to improve the effect recognized in case of adding the releasing agent in the toner (offset resistance) and to improve the transparency and positively charging property, and to prevent filming and to reduce wear of the photoconductor drum. Therefore, a polyolefine having a predetermined acid value, weight-average molecular weight and particle diameter is employed.

That is, the releasing agent used in the present invention includes a polyolefine having an acid value of not more than 10 KOHmg/g and a weight-average molecular weight of 8,000 to 15,000, a proportion of a polyolefine having a particle diameter (measured by observing using a transmission electron microscope) of not less than 1.5 $\mu$m among polyolefines dispersed in the toner being within 1% in terms of the number. Particularly, the acid value is preferably from 0 to 8 KOHmg/g within the above range. When the acid value of the polyolefine exceeds 10 KOHmg/g, the positively charging property of the toner is lowered even if the above specific polyester resin and positive charging electric charge controlling resin are mixed.

To adjust the acid value of the polyolefine within the above range, the polyolefine may be copolymerized with acrylic acid or methacrylic acid to perform the reactions such as esterification, epoxidation, amidation and the like using a suitable substance in the same manner as that used in adjustment of the acid value in the polyester resin, thereby to neutralize the carboxyl group of acrylic acid.

The weight-average molecular weight of the polyolefine is smaller than 8,000, agglomeration occurs again during the kneading and the dispersion property of the toner is lowered and, therefore, good transparency is not obtained. On the other hand, when the weight-average molecular weight of the polyolefine is larger than 15,000, the resulting toner becomes comparatively hard. Therefore, when the toner is exposed on the surface, wear of the photoconductor drum is likely to occurs. Furthermore, the offset resistance also becomes insufficient and an offset phenomenon is liable to occur.

In case of the toner using a polyolefine wherein a proportion of a polyolefine having a particle diameter (measured by observing using a transmission electron microscope) of not less than 1.5 $\mu$m among polyolefines dispersed in the toner being within 1% in terms of the number, wear of the photoconductor drum can be reduced, but the positively charging property and transparency are lowered. Furthermore, the toner is liable to be fused on the surface of the photoconductor drum and filming is likely to occur.

Examples of the polyolefine include low-molecular weight polypropylene or low-molecular weight polyethylene having a weight-average molecular weight within the above range. These polyolefines can be used alone or in combination thereof.

The amount of the polyolefine may be from 0.1 to 7 parts by weight, and preferably from 0.2 to 5 parts by weight, based on 100 parts by weight of the polyester resin. When the amount of the polyolefine exceeds the above range, the transparency and positively charging property are lowered. On the other hand, when the amount of the polyolefine is smaller than the above range, wear of the photoconductor drum can not be reduced and the offset resistance is also insufficient.

The positive charging electric charge controlling material to be mixed, together with the above polyester resin, includes a polymer substance having a functional group capable of imparting the positively charging property to the toner at the side chain.

Examples of the functional group include various groups, and a group corresponding to a quaternary ammonium salt is particularly preferred. Among them, a trialkylammonio group represented by the above general formula (6) is more preferred because of its excellent function of imparting positively charging property.

As the main chain of the electric charge controlling resin, various polymer main chains can be used. Since the compatibility with the polyester resin as the fixing resin is particularly important in view of the transparency and positively charging property, it is preferred to use a polymer main chain having good compatibility with the above polyester resin.

Examples of the polymer main chain include styrene-acrylate resins such as styrene-acrylate copolymer, styrene-methacrylate copolymer and the like. In case that the styrene-acrylate resin is a main chain, the functional group is preferably substituted on the ester portion of the acrylate.

Other characteristics of the electric charge controlling resin are not specifically limited, but the molecular weight is from about 8,000 to 18,000, and preferably from about 10,000 to 15,000, in terms of the weight-average molecular weight. The amount of the electric charge controlling material is not specifically limited, but is normally from 0.5 to 20 parts by weight, and preferably from 3 to 12 parts by weight, based on 100 parts by weight of the polyester resin.

When the amount of the electric charge controlling material exceeds 20 parts by weight, the compatibility with the polyester resin becomes inferior and the transparency of the toner is likely to be lowered. On the other hand, when the amount of the electric charge controlling material is smaller than 0.5 parts by weight, there is a fear that the effect of imparting the positively charging property due to mixing of the electric charge controlling material is not sufficiently obtained.

Examples of the coloring agent includes various coloring pigments and loading pigments, but the followings can be preferably used.

The amount of the coloring agent may be from 2 to 10 parts by weight, and preferably from 3 to 8 parts by weight, based on 100 parts by weight of the polyester resin.

The positive charging one-component non-magnetic color toner of the present invention is produced by homogeneously premixing the above respective components using a dry blender, Henshel mixer, ball mill or the like to obtain a mixture; uniformly melting and kneading the resulting mixture using a kneading device such as single or twin screw kneading extruder; cooling and grinding the resulting kneaded product; and optionally classifying the ground particles.

The particle diameter of the positive charging one-component non-magnetic color toner thus obtained is appropriately adjusted according to the service purpose, but may be within a range from about 5 to 12 $\mu$m, and preferably from about 6 to 10 $\mu$m, for the purpose of realizing high image quality of the formed image.

To the positive charging one-component non-magnetic color toner particles, conventionally known surface treating agents such as inorganic fine particles, fluororesin fine particles and the like can also be added to improve the fluidity and charging characteristics. Particularly, there can preferably be used silica surface treating agents containing hydrophobic or hydrophilic silica fine particles, for example, anhydrous silica and colloidal silica in the form of ultrafine particles. The amount of the surface treating agent to be added may be the same as that of the prior art. Specifically, the amount may be preferably about 0.1 to 2.0 parts by weight based on 100 parts by weight of the toner particles.

The positive charging color toner of the present invention is superior in positively charging property and environmental resistance and has high durability, and also has the effect capable of preventing fusion of the toner onto the blade. Accordingly, by using the color toner of the present invention, not only an image having good image quality can be formed without causing image defects such as lowering of the image density and fog due to unstable charging characteristics and fusion of the toner onto the blade, but also requirements such as power saving to the image forming apparatus can be satisfied.

The positive charging one-component non-magnetic color toner of the present invention is superior in transparency, offset resistance, low-temperature fixing property and positively charging property, and also has the effect capable of preventing filming and wear of the photoconductor drum. Accordingly, by using the positive charging one-component non-magnetic color toner of the present invention, not only an image having good image quality can be formed without causing image defects such as lowering of the image density and fog due to wear of the photoconductor drum, filming and unstable charging characteristics, but also requirements such as power saving and long life to the image forming apparatus can be satisfied.

EXAMPLES

The following Examples, Comparative Examples and Comparative Reference Example further illustrate the present invention in detail.

Example 1

100 Parts by weight of an urethane-modified polyester resin of the type of the above term (1) [polycondensate of propylene oxide adduct of bisphenol A and terephthalic acid, weight-average molecular weight: 18,000, number-average molecular weight: 6,700, acid value (AV): 2.30 KOHmg/g, hydroxyl value (OHV): 5.8 KOHmg/g) as the fixing resin, 7 parts by weight of a quaternary ammonium salt "VP2038" (supra) as the electric charge controlling material, and 12.5 parts by weight of a mixture of the above polyester resin and Pigment Red 122 in a weight ratio of 6:4 (former:latter) were dry-mixed by using a Henschel mixer, molten and kneaded by using a twin-screw extruder, ground by using a jet mill and then classified by using an air classification device to produce a positive charging electrophotographic toner having a particle diameter of 8.2 $\mu$m.

A commercially available laser printer (Model LDC720, manufactured by Mita Industrial Co., Ltd.) was modified to a laser printer for non-magnetic one-component contact reversal development method using a positively charging photoconductor drum and was used as a test apparatus.

The above toner was subjected to the following plate wear test under conditions of normal-temperature/normal-humidity (N/N) [ambient temperature: 25° C., relative humidity: 60%].

Charge Amount

The toner on a developing roller after printing about 40,000 copies was sucked by using a Faraday gauge and the specific electric charge was measured by using an electrometer TR-8652 manufactured by ADVANTEST CORPORATION to determine the charge amount per 1 g.

Fog Density

Using a Macbeth densitometer manufactured by Nippon Denshoku Ind. Co., Ltd., the density of the blank paper portion after printing about 40,000 copies was measured. Then, a difference between the density of the blank paper and the base density (density of a non-transferred paper) was determined and the resulting value was taken as a fog density.

Blade Fusion

A developing doctor blade after printing 40,000 copies was observed by using an optical microscope and the degree of fusion was judged according to the following evaluation criteria.

○: No adhesion is observed.

Δ: Slight adhesion is observed, but does not appear in the image.

× Adhesion appears in the image.

Fixing Property

○: It shows good fixing, and color reproducibility is good.

Δ: Color reproducibility is good, but light transmittance is inferior in case of fixing the image on OHP.

× Fixing defect occurs at the beginning of the printing and color reproducibility is inferior.

Environmental Resistance

The charge amount and fog density were measured under the conditions of high-temperature/high-humidity (H/H) [ambient temperature: 32.5° C., relative humidity: 80%] and the conditions of low-temperature/low-humidity (L/L) [ambient temperature: 10° C., relative humidity: 20%] according to the same manner as that in case of the measurement under the conditions of normal-temperature/normal-humidity (N/N).

Examples 2–6 and Comparative Examples 1–8

According to the same manner as that described in Example 1 except for using the urethane-modified polyester resin, electric charge controlling material (quaternary ammonium salt having a melting point of not less than 200° C. described in this specification) and coloring agent shown in the following Tables 1–3, a positive charging electrophotographic toner was produced.

In Comparative Example 1, a polyester resin wherein a hydroxyl group is not converted into an urethane group [weight-average molecular weight: 48,000, number-average molecular weight: 5,200, acid value (AV): 7.2 KOHmg/g, hydroxyl value (OHV): 2.9 KOHmg/g] was used. As the electric charge controlling material of Comparative Example 8, "P-51" (trade name) (melting point: 185° C.) manufactured by Orient Chemical Industries Ltd. was used.

Example 7

According to the same manner as that described in Example 1 except for using the same parts by weight of an electric charge controlling resin wherein a functional group is a trialkylammonio group represented by the above general formula (5) and a main chain is a styrene-acrylate resin having a glass transition temperature Tg of 66° C. in place of the quaternary ammonium salt, a positive charging electrophotographic toner was produced.

Examples 8–12 and Comparative Examples 9–14

According to the same manner as that described in Example 7 except for using the urethane-modified polyester resin, electric charge controlling material (styrene-acrylate resin having a glass transition temperature Tg different from that of Example 7) and coloring agent shown in the following Tables 4 and 5, a positive charging electrophotographic toner was produced.

In Comparative Example 14, a polyester resin wherein a hydroxyl group is not converted into an urethane group [weight-average molecular weight: 16,000, number-average molecular weight: 5,000, acid value (AV): 2.3 KOHmg/g, hydroxyl value (OHV): 5.7 KOHmg/g] was used.

Comparative Reference Example

According to the same manner as that described in Example 1 except for using the same parts by weight of a nigrosine pigment (Bontron No. 1, manufactured by Orient Chemical Industries Ltd.) in place of the quaternary ammonium salt "VP2038", a positive charging electrophotographic toner was produced.

The molecular weight distribution of the urethane-modified polyester resin shown in Tables 1–5 is a value measured by gel permeation chromatogram manufactured by Toyo Soda Manufacturing Co., Ltd.

With respect to the toners of Examples 2–12, Comparative Examples 1–14 and Comparative Reference Example, the charge amount (under the conditions of normal-temperature/normal-humidity, high-temperature/high-humidity and low-temperature/low-humidity), fog density (under the conditions of normal-temperature/normal-humidity, high-temperature/high-humidity and low-temperature/low-humidity) and blade fusion were examined according to the same manner as that described in Example 1.

The test results are shown in the following Tables 1–5, together with the amount of the respective components.

TABLE 1

| | EXAMPLE 1 | EXAMPLE 2 | EXAMPLE 3 | EXAMPLE 4 | EXAMPLE 5 | EXAMPLE 6 |
|---|---|---|---|---|---|---|
| (FIXING RESIN) | | | | | | |
| WEIGHT-AVERAGE MOLECULAR WEIGHT (Mw) | 18,000 | 12,000 | 61,000 | 28,000 | 58,000 | 110,000 |
| NUMBER-AVERAGE MOLECULAR WEIGHT (Mn) | 6,700 | 6,200 | 3,500 | 5,800 | 4,500 | 4,600 |
| ACID VALUE | 2.3 | 4.1 | 4.1 | 2.5 | 2.4 | 2.9 |
| HYDROXYL VALUE | 5.8 | 7.3 | 5.8 | 7.4 | 6.7 | 2.5 |
| AMOUNT (PARTS BY WEIGHT) | 107.5 | 100 | 100 | 107.5 | 107.5 | 107.5 |
| (ELECTRIC CHARGE CONTROLLING MATERIAL) | | | | | | |
| QUATERNARY AMMONIUM SALT | VP2038 | TP302 | A-902 | TP415 | VP2035 | TP4040 |
| MELTING POINT (° C.) | 215 | 215 | 210 | 204 | 200 | 209 |
| AMOUNT (PARTS BY WEIGHT) | 7 | 7 | 7 | 7 | 7 | 7 |
| (COLORING AGENT) | P.R.122 | CARBON BLACK 1 | CARBON BLACK 2 | P.B. 15 | P.Y. 17 | P.Y. 14 |
| AMOUNT (PARTS BY WEIGHT) | 5 | 5 | 5 | 5 | 5 | 5 |
| PLATE WEAR TEST | | | | | | |
| CHARGE AMOUNT (μC/g) | | | | | | |
| BEFORE PRINTING | 25.6 | 23.6 | 22.1 | 21.8 | 20.1 | 20.3 |
| AFTER PRINTING | 26.2 | 24.2 | 23.1 | 23.1 | 22.1 | 21.6 |
| BLADE FUSION | ○ | ○ | ○ | ○ | ○ | ○ |
| FIXING PROPERTY | ○ | ○ | ○ | ○ | ○ | ○ |
| FOG DENSITY | | | | | | |
| BEFORE PRINTING | 0.002 | 0.001 | 0.002 | 0.003 | 0.001 | 0.001 |
| AFTER PRINTING | 0.003 | 0.001 | 0.002 | 0.002 | 0.002 | 0.001 |
| ENVIRONMENTAL RESISTANCE | | | | | | |
| CHARGE AMOUNT (μC/g) | | | | | | |
| HIGH-TEMPERATURE/ HIGH-HUMIDITY | 21.8 | 22.9 | 21.3 | 20.1 | 20.9 | 19.8 |
| LOW-TEMPERATURE/ LOW-HUMIDITY | 26.2 | 24.2 | 24.9 | 25.1 | 22.8 | 22.1 |
| FOG DENSITY | | | | | | |
| HIGH-TEMPERATURE/ HIGH-HUMIDITY | 0.002 | 0.002 | 0.003 | 0.004 | 0.003 | 0.004 |
| LOW-TEMPERATURE/ LOW-HUMIDITY | 0.003 | 0.001 | 0.002 | 0.003 | 0.002 | 0.003 |

NOTE) CARBON BLACK 1: CARBON BLACK #44 (SUPRA)
CARBON BLACK 2: CARBON BLACK PRINTEX L (SUPRA)

TABLE 2

| | COMP. EX. 1 | COMP. EX. 2 | COMP. EX. 3 | COMP. EX. 4 |
|---|---|---|---|---|
| (FIXING RESIN) | | | | |
| WEIGHT-AVERAGE MOLECULAR WEIGHT (Mw) | 48,000 | 32,000 | 18,000 | 6,900 |
| NUMBER-AVERAGE MOLECULAR WEIGHT (Mn) | 5,200 | 4,900 | 5,800 | 5,100 |
| ACID VALUE | 7.2 | 8.0 | 2.9 | 1.2 |
| HYDROXYL VALUE | 2.9 | 2.1 | 12.0 | 5.2 |
| AMOUNT (PARTS BY WEIGHT) | 100 | 107.5 | 107.5 | 107.5 |
| (ELECTRIC CHARGE CONTROLLING MATERIAL) | | | | |
| QUATERNARY AMMONIUM SALT | TP302 | TP4040 | TP415 | TP4040 |
| MELTING POINT (° C.) | 215 | 209 | 204 | 209 |
| AMOUNT (PARTS BY WEIGHT) | 7 | 7 | 7 | 7 |
| (COLORING AGENT) | CARBON BLACK 1 | P.Y. 14 | P.B. 15 | P.Y. 14 |
| AMOUNT (PARTS BY WEIGHT) | 5 | 5 | 5 | 5 |
| PLATE WEAR TEST | | | | |
| CHARGE AMOUNT ($\mu$C/g) | | | | |
| BEFORE PRINTING | 16.8 | 5.6 | 12.8 | 16.5 |
| AFTER PRINTING | 12.8 | 6.4 | 9.2 | 19.2 |
| BLADE FUSION | ○ | ○ | ○ | X |
| FIXING PROPERTY | ○ | ○ | ○ | X |
| FOG DENSITY | | | | |
| BEFORE PRINTING | 0.006 | 0.023 | 0.008 | 0.005 |
| AFTER PRINTING | 0.024 | 0.031 | 0.015 | 0.008 |
| ENVIRONMENTAL RESISTANCE | | | | |
| CHARGE AMOUNT ($\mu$C/g) | | | | |
| HIGH-TEMPERATURE/ HIGH-HUMIDITY | 15.6 | 1.9 | 9.8 | 19.8 |
| LOW-TEMPERATURE/ LOW-HUMIDITY | 20.1 | 5.6 | 12.9 | 19.8 |
| FOG DENSITY | | | | |
| HIGH-TEMPERATURE/ HIGH-HUMIDITY | 0.008 | 0.046 | 0.018 | 0.007 |
| LOW-TEMPERATURE/ LOW-HUMIDITY | 0.005 | 0.031 | 0.012 | 0.005 |

NOTE) CARBON BLACK 1: CARBON BLACK #44 (SUPRA)

TABLE 3

| | COMP. EX. 5 | COMP. EX. 6 | COMP. EX. 7 | COMP. EX. 8 |
|---|---|---|---|---|
| (FIXING RESIN) | | | | |
| WEIGHT-AVERAGE MOLECULAR WEIGHT (Mw) | 140,000 | 18,000 | 17,000 | 18,000 |
| NUMBER-AVERAGE MOLECULAR WEIGHT (Mn) | 6,400 | 1,700 | 9,800 | 6,700 |
| ACID VALUE | 1.6 | 2.8 | 1.3 | 2.3 |
| HYDROXYL VALUE | 4.6 | 7.9 | 6.3 | 5.8 |
| AMOUNT (PARTS BY WEIGHT) | 107.5 | 107.5 | 107.5 | 107.5 |
| (ELECTRIC CHARGE CONTROLLING MATERIAL) | | | | |
| QUATERNARY AMMONIUM SALT | VP2035 | VP2038 | A-902 | P-51 |
| MELTING POINT (° C.) | 200 | 215 | 210 | 185 |
| AMOUNT (PARTS BY WEIGHT) | 7 | 7 | 7 | 7 |
| (COLORING AGENT) | P.Y. 17 | P.R. 122 | CARBON BLACK 1 | P.R. 122 |
| AMOUNT (PARTS BY WEIGHT) | 5 | 5 | 5 | 5 |
| PLATE WEAR TEST | | | | |
| CHARGE AMOUNT ($\mu$C/g) | | | | |
| BEFORE PRINTING | 15.8 | 12.8 | 12.9 | 4.6 |
| AFTER PRINTING | 18.2 | 20.1 | 9.8 | — |
| BLADE FUSION | ○ | X | ○ | — |

TABLE 3-continued

| | COMP. EX. 5 | COMP. EX. 6 | COMP. EX. 7 | COMP. EX. 8 |
|---|---|---|---|---|
| FIXING PROPERTY | X | X | X | ○ |
| FOG DENSITY | | | | |
| BEFORE PRINTING | 0.004 | 0.008 | 0.008 | 0.016 |
| AFTER PRINTING | 0.009 | 0.014 | 0.015 | — |
| ENVIRONMENTAL RESISTANCE | | | | |
| CHARGE AMOUNT (μC/g) | | | | |
| HIGH-TEMPERATURE/ HIGH-HUMIDITY | 18.7 | 18.9 | 19.2 | 4.2 |
| LOW-TEMPERATURE/ LOW-HUMIDITY | 16.9 | 20.1 | 13.8 | 6.2 |
| FOG DENSITY | | | | |
| HIGH-TEMPERATURE/ HIGH-HUMIDITY | 0.006 | 0.008 | 0.007 | 0.054 |
| LOW-TEMPERATURE/ LOW-HUMIDITY | 0.004 | 0.006 | 0.005 | 0.019 |

NOTE) CARBON BLACK 2: CARBON PRINTEX L (SUPRA)

TABLE 4

| | EXAMPLE 7 | EXAMPLE 8 | EXAMPLE 9 | EXAMPLE 10 | EXAMPLE 11 | EXAMPLE 12 |
|---|---|---|---|---|---|---|
| (FIXING RESIN) | | | | | | |
| WEIGHT-AVERAGE MOLECULAR WEIGHT (MW) | 15,000 | 8,500 | 16,000 | 11,000 | 22,000 | 100,000 |
| NUMBER-AVERAGE MOLECULAR WEIGHT (Mn) | 4,800 | 2,700 | 5,300 | 4,100 | 5,900 | 6,500 |
| ACID VALUE | 2.1 | 3.2 | 1.4 | 1.0 | 4.2 | 2.6 |
| HYDROXYL VALUE | 5.4 | 8.5 | 6.6 | 4.7. | 7.6 | 5.2 |
| AMOUNT (PARTS BY WEIGHT) | 107.5 | 100 | 100 | 107.5 | 107.5 | 107.5 |
| (STYRENE-ACRYLATE RESIN) | | | | | | |
| GLASS TRANSITION TEMPERATURE (° C.) | 66 | 66 | 62 | 58 | 60 | 66 |
| AMOUNT (PARTS BY WEIGHT) | 7 | 7 | 7 | 7 | 7 | 7 |
| (COLORING AGENT) | P.R. 122 | CARBON BLACK 1 | CARBON BLACK 2 | P.B. 15 | P.Y. 17 | P.Y. 14 |
| AMOUNT (PARTS BY WEIGHT) | 5 | 5 | 5 | 5 | 5 | 5 |
| PLATE WEAR TEST | | | | | | |
| CHARGE AMOUNT (μC/g) | | | | | | |
| BEFORE PRINTING | 23.5 | 25.6 | 24.1 | 23.2 | 20.5 | 20.9 |
| AFTER PRINTING | 22.8 | 24.8 | 22.2 | 21.5 | 18.8 | 20.1 |
| BLADE FUSION | ○ | ○ | ○ | ○ | ○ | ○ |
| FIXING PROPERTY | ○ | ○ | ○ | ○ | ○ | ○ |
| FOG DENSITY | | | | | | |
| BEFORE PRINTING | 0.001 | 0.002 | 0.001 | 0.002 | 0.002 | 0.002 |
| AFTER PRINTING | 0.002 | 0.003 | 0.003 | 0.003 | 0.003 | 0.004 |
| ENVIRONMENTAL RESISTANCE | | | | | | |
| CHARGE AMOUNT (μC/g) | | | | | | |
| HIGH-TEMPERATURE/ HIGH-HUMIDITY | 22.4 | 23.1 | 23.8 | 21.8 | 19.7 | 19.2 |
| LOW-TEMPERATURE/ LOW-HUMIDITY | 23.0 | 24.8 | 24.5 | 23.1 | 21.2 | 21.2 |
| FOG DENSITY | | | | | | |
| HIGH-TEMPERATURE/ HIGH-HUMIDITY | 0.003 | 0.004 | 0.002 | 0.003 | 0.004 | 0.003 |
| LOW-TEMPERATURE/ LOW-HUMIDITY | 0.002 | 0.002 | 0.003 | 0.003 | 0.003 | 0.002 |

NOTE) CARBON BLACK 1: CARBON BLACK #44 (SUPRA)
CARBON BLACK 2: CARBON BLACK PRINTEX L (SUPRA)

TABLE 5

| | COMP. EX. 9 | COMP. EX. 10 | COMP. EX. 11 | COMP. EX. 12 |
|---|---|---|---|---|
| (FIXING RESIN) | | | | |
| WEIGHT-AVERAGE MOLECULAR WEIGHT (Mw) | 16,000 | 14,000 | 7,000 | 130,000 |
| NUMBER-AVERAGE MOLECULAR WEIGHT (Mn) | 4,900 | 4,700 | 1,500 | 8,100 |
| ACID VALUE | 22 | 2.5 | 2.5 | 2.0 |
| HYDROXYL VALUE | 35 | 14 | 7.1 | 6.4 |
| AMOUNT (PARTS BY WEIGHT) | 107.5 | 107.5 | 107.5 | 107.5 |
| (STYRENE-ACRYLATE RESIN) | | | | |
| GLASS TRANSITION TEMPERATURE (° C.) | 66 | 66 | 66 | 66 |
| AMOUNT (PARTS BY WEIGHT) | 7 | 7 | 7 | 7 |
| (COLORING AGENT) | P.R. 122 | P.R. 122 | P.R. 122 | P.R. 122 |
| AMOUNT (PARTS BY WEIGHT) | 5 | 5 | 5 | 5 |
| PLATE WEAR TEST | | | | |
| CHARGE AMOUNT (μC/g) | | | | |
| BEFORE PRINTING | 6.5 | 14.8 | 20.1 | 21.5 |
| AFTER PRINTING | — | 9.8 | 18.1 | 18.4 |
| BLADE FUSION | — | ○ | X | ○ |
| FIXING PROPERTY | ○ | ○ | X | X |
| FOG DENSITY | | | | |
| BEFORE PRINTING | 0.025 | 0.005 | 0.003 | 0.003 |
| AFTER PRINTING | — | 0.012 | 0.007 | 0.006 |
| ENVIRONMENTAL RESISTANCE | | | | |
| CHARGE AMOUNT (μC/g) | | | | |
| HIGH-TEMPERATURE/ HIGH-HUMIDITY | 2.1 | 9.2 | 18.4 | 17.8 |
| LOW-TEMPERATURE/ LOW-HUMIDITY | 5.1 | 11.8 | 19.2 | 18.5 |
| FOG DENSITY | | | | |
| HIGH-TEMPERATURE/ HIGH-HUMIDITY | 0.051 | 0.018 | 0.005 | 0.004 |
| LOW-TEMPERATURE/ LOW-HUMIDITY | 0.028 | 0.009 | 0.004 | 0.003 |

| | COMP. EX. 13 | COMP. EX. 14 | COMPARATIVE REFERENCE EXAMPLE |
|---|---|---|---|
| (FIXING RESIN) | | | |
| WEIGHT-AVERAGE MOLECULAR WEIGHT (Mw) | 15,000 | 16,000 | 15,000 |
| NUMBER-AVERAGE MOLECULAR WEIGHT (Mn) | 4,800 | 5,000 | 4,800 |
| ACID VALUE | 2.1 | 2.3 | 2.1 |
| HYDROXYL VALUE | 5.4 | 5.7 | 5.4 |
| AMOUNT (PARTS BY WEIGHT) | 107.5 | 107.5 | 107.5 |
| (STYRENE-ACRYLATE RESIN) | | | |
| GLASS TRANSITION TEMPERATURE (° C.) | 46 | 66 | —* |
| AMOUNT (PARTS BY WEIGHT) | 7 | 7 | 7 |
| (COLORING AGENT) | P.R. 122 | P.R. 122 | P.R. 122 |
| AMOUNT (PARTS BY WEIGHT) | 5 | 5 | 5 |
| PLATE WEAR TEST | | | |
| CHARGE AMOUNT (μC/g) | | | |
| BEFORE PRINTING | 15.4 | 15.9 | 14.5 |
| AFTER PRINTING | 12.4 | 11.8 | 8.9 |
| BLADE FUSION | X | ○ | ○ |
| FIXING PROPERTY | X | ○ | ○ |
| FOG DENSITY | | | |
| BEFORE PRINTING | 0.012 | 0.008 | 0.005 |
| AFTER PRINTING | 0.017 | 0.020 | 0.016 |
| ENVIRONMENTAL RESISTANCE | | | |
| CHARGE AMOUNT (μC/g) | | | |
| HIGH-TEMPERATURE/ HIGH-HUMIDITY | 11.4 | 12.8 | 10.2 |
| LOW-TEMPERATURE/ | 12.2 | 21.8 | 11.4 |

TABLE 5-continued

| LOW-HUMIDITY FOG DENSITY | | | |
|---|---|---|---|
| HIGH-TEMPERATURE/ HIGH-HUMIDITY | 0.014 | 0.009 | 0.010 |
| LOW-TEMPERATURE/ LOW-HUMIDITY | 0.012 | 0.004 | 0.008 |

*: As an electric charge controlling material, a nigrosine dye "BONTORON NO. 1" (supra) was used.

As a result, it has been found that the toners produced in the respective Examples of the present invention are superior in positively charging property and fixing property to the Comparative Examples, and that no fusion is recognized on the blade and the fog density is small. It has also been found that the toners of the Examples are also superior in positively charging property to the Comparative Examples even under the conditions of high-temperature/high-humidity and low-temperature/low-humidity, and that the fog density is small and the charge amount and a change in fog density are small even under both severe conditions.

Regarding the toners of Comparative Examples 8 and 9, the fog density increased with the increase of the number of copies and, therefore, the plate were test was stopped.

Example 13

100 Parts by weight of a polyester resin of the type of the above term (1) [weight-average molecular weight: 15,000, number-average molecular weight: 4,500, acid value (AV): 3 KOHmg/g, hydroxyl value (OHV): 5 KOHmg/g) as the fixing resin, 5 parts by weight of an electric charge controlling material wherein a main chain is a styrene-acrylate copolymer and a functional group is a trialkylammonio group (molecular weight: 15,000) represented by the general formula (7), 12.5 parts by weight of a mixture of the above polyester resin and Pigment Red 57-1 in a weight ratio of 6:4 (former:latter) and 7 parts by weight of a polypropylene wax [weight-average molecular weight: 10,000, acid value (AV): 7 KOHmg/g] as the releasing agent were dry-mixed by using a Henschel mixer, molten and kneaded by using a twin-screw extruder, ground by using a jet mill and then classified by using an air classification device to produce toner particles having an average particle diameter of 8 $\mu$m.

To 100 parts by weight of the above toner particles, 0.4 parts by weight of a hydrophobic silica subjected to a polysiloxane treatment was added to produce a positive charging electrophotographic toner.

Particle Diameter of Releasing Agent in Toner

A portion of the toners thus obtained was cut into pieces of 30 cm in thickness by using a microtome and cross sections of twenty or more toners were observed by using a transmission electron microscope by magnification of 6,000. Then, the evaluation was performed by the following criteria.

○: A proportion of a releasing agent having a particle diameter of not less than 1.5 $\mu$m in the toner were within 1% in terms of the number.

×: A proportion of a releasing agent having a particle diameter of not less than 1.5 $\mu$m in the toner exceeded 1% in terms of the number.

Measurement of Wear Mount of Photoconductor Drum

A commercially available laser printer [Model LDC720, manufactured by Mita Industrial Co., Ltd.] was modified to a laser printer for non-magnetic one-component contact reversal development method using a positively charging photoconductor drum and was used as a test apparatus. After printing 40,000 copies by using the above toner and test apparatus, the wear amount of the photoconductor drum after 40,000 copies was measured at twenty points including four points in the circumferential direction and five points in the axial direction by using an eddy current type film thickness gauge. Then, an average value of differences before and after printing was determined and the resulting value was taken as a wear amount of the photoconductor drum.

Fog Density

Using a Macbeth densitometer manufactured by Nippon Denshoku Co., Ltd., the density of the blank paper after printing about 40,000 copies was measured. Then, a difference between the density of the blank paper and the base density (density of a non-transferred paper) was determined and the resulting value was taken as a fog density.

Blade Fusion

A developing doctor blade after taking 40,000 copies was observed by using an optical microscope and the degree of fusion was judged according to the following evaluation criteria.

○: No adhesion is observed.

Δ: Slight adhesion is observed, but does not appear in the image.

× Adhesion appears in the image.

Offset Resistance

It was observed whether an offset phenomenon occurs or not while printing 40,000 copies, and the evaluation was performed according to the following criteria.

○: No offset phenomenon is recognized and offset resistance is good.

Δ: Offset phenomenon is recognized and offset resistance is poor.

Transparency

Using the above Macbeth densitometer, the density of the solid portion and the solid transmittance when the solid density is 2.0 was measured by using a spectrophotometer.

The transmittance in each coloring agent was compared with the transmittance at the following measuring wavelength.

Magenta: maximum wavelength at 380–550 nm

Cyane: 580 nm

Yellow: 520 nm

Sucked Charge Amount

The toner on a developing roller after printing about 40,000 copies was sucked by using a Faraday gage and the specific electric charge was measured by using an electrometer TR-8652 manufactured by ADVANTEST CORPORATION to determine the charge amount per 1 g.

Examples 14–16 and Comparative Examples 15–21

According to the same manner as that described in Example 13 except for using the polyester resin, releasing agent and coloring agent shown in the following Tables 6 and 7, a positive charging electrophotographic toner was produced.

The toner of Comparative Example 17 was produced by setting the mixing and/or kneading conditions so that a proportion of a polyolefine having a particle diameter of not less than 1.5 μm among polyolefines dispersed in the toner becomes 2% in terms of the number.

The molecular weight distribution of the polyester resin and releasing agent (polyolefine) shown in Tables 6 and 7 is a value measured by gel permeation chromatogram manufactured by Toyo Soda Co., Ltd.

With respect to the toners of Examples 14–16 and Comparative Examples 15–19, the particle diameter of the releasing agent (polyolefine) in the toner, wear amount of the drum, fog density, blade fusion, absence or presence of an offset phenomenon, and transparency (except for Example 14 and Comparative Example 16) were examined according to the same manner as that described in Example 13. The test results are shown in the following Tables 6 and 7, together with the amount of the respective components.

TABLE 6

| | EXAMPLE 13 | EXAMPLE 14 | EXAMPLE 15 | EXAMPLE 16 | COMP. EX. 15 | COMP. EX. 16 |
|---|---|---|---|---|---|---|
| (POLYESTER RESIN) | | | | | | |
| WEIGHT-AVERAGE MOLECULAR WEIGHT (Mw) | 13,000 | 18,000 | 7,000 | 18,000 | 21,000 | 6,000 |
| NUMBER-AVERAGE MOLECULAR WEIGHT (Mn) | 4,000 | 5,500 | 1,000 | 5,500 | 6,200 | 900 |
| ACID VALUE | 3.2 | 4.8 | 3.2 | 4.8 | 3.5 | 3.6 |
| HYDROXYL VALUE | 5.2 | 8.2 | 5.2 | 8.2 | 3.8 | 4.2 |
| (RELEASING AGENT) | | | | | | |
| WEIGHT-AVERAGE MOLECULAR WEIGHT (Mw) | 10,000 | 14,000 | 14,000 | 10,000 | 16,000 | 7,800 |
| ACID VALUE | 7.0 | 9.1 | 9.1 | 7.0 | 6.5 | 7.5 |
| PARTICLE DIAMETER (NOT LESS THAN 1.5 μm) | ○ | ○ | ○ | ○ | ○ | ○ |
| AMOUNT (PARTS BY WEIGHT)* | 2 | 4 | 4 | 2 | 2 | 2 |
| (ELECTRIC CHARGE CONTROLLING RESIN) | | | | | | |
| AMOUNT (PARTS BY WEIGHT)* | % | 7 | 5 | 7 | 5 | 7 |
| (COLORING AGENT) | P.R. 57-1 | CARBON BLACK | P.B. 15-3 | P.Y. 97 | P.R. 57-1 | CARBON BLACK |
| AMOUNT (PARTS BY WEIGHT) | 12.5 | 12.5 | 12.5 | 12.5 | 12.5 | 12.5 |
| (TONER PROPERTY) | | | | | | |
| WEAR AMOUNT OF DRUM (μm) | 3.7 | 4.2 | 3.9 | 4.0 | 8.2 | 4.5 |
| BLADE FUSION | ○ | ○ | ○ | ○ | ○ | X |
| OFFSET RESISTANCE | ○ | ○ | ○ | ○ | X | |
| FOG DENSITY | 0.001 | 0.002 | 0.001 | 0.002 | 0.003 | 0.010 |
| TRANSPARENCY (%) | 61 | — | 31 | 71 | 52 | — |
| CHARGE AMOUNT | | | | | | |
| BEFORE PRINTING (μC/g) | 23 | 32 | 31 | 24 | 21 | 30 |
| AFTER PRINTING (μC/g) | 20 | 29 | 28 | 23 | 19 | 12 |

*: Amount based on 100 parts by weight of polyester resin

TABLE 7

| | COMP. EX. 17 | COMP. EX. 18 | COMP. EX. 19 | COMP. EX. 20 | COMP. EX. 21 |
|---|---|---|---|---|---|
| (POLYESTER RESIN) | | | | | |
| WEIGHT-AVERAGE MOLECULAR WEIGHT (Mw) | 13,000 | 13,000 | 13,000 | 18,000 | 13,000 |
| NUMBER-AVERAGE MOLECULAR WEIGHT (Mn) | 4,000 | 4,000 | 4,000 | 5,500 | 4,000 |
| ACID VALUE | 3.2 | 5.2 | 3.2 | 4.8 | 3.2 |
| HYDROXYL VALUE | 5.2 | 9.5 | 5.2 | 8.2 | 5.2 |
| (RELEASING AGENT) | | | | | |
| WEIGHT-AVERAGE MOLECULAR WEIGHT (Mw) | 10,000 | 10,000 | — | 10,000 | 10,000 |
| ACID VALUE | 7.0 | 11.0 | — | 7.0 | 7.0 |
| PARTICLE DIAMETER (NOT LESS THAN 1.5 μm) | X | ○ | — | ○ | ○ |
| AMOUNT (PARTS BY WEIGHT)* | 2 | 2 | — | 2 | 5.2 |
| (ELECTRIC CHARGE CONTROLLING RESIN) | | | | | |
| AMOUNT (PARTS BY WEIGHT)* | 5 | 5 | 5 | — | 5 |
| (COLORING AGENT) | P.B. 15-3 | P.R. 57-1 | P.R. 57-1 | P.Y. 97 | P.R. 57-1 |

TABLE 7-continued

| | COMP. EX. 17 | COMP. EX. 18 | COMP. EX. 19 | COMP. EX. 20 | COMP. EX. 21 |
|---|---|---|---|---|---|
| AMOUNT (PARTS BY WEIGHT)* | 12.5 | 12.5 | 12.5 | 12.5 | 12.5 |
| (TONER PROPERTY) | | | | | |
| WEAR AMOUNT OF DRUM (μm) | 6.5 | 4.6 | 10.1 | 5.1 | 3.6 |
| BLADE FUSION | X | ○ | ○ | ○ | Δ |
| OFFSET RESISTANCE | ○ | ○ | X | ○ | ○ |
| FOG DENSITY | 0.012 | 0.023 | 0.002 | 0.042 | 0.025 |
| TRANSPARENCY (%) | 21 | 60 | 65 | 73 | 32 |
| CHARGE AMOUNT | | | | | |
| BEFORE PRINTING (μC/g) | 30 | 16 | 24 | 9 | 19 |
| AFTER PRINTING (μC/g) | 13 | 9 | 22 | 4 | 11 |

*: Amount based on 100 parts by weight of polyester resin

As a result, it has been found that the toners of the respective Examples hardly cause wear of the drum in comparison with the toners of the Comparative Examples and are superior in offset resistance and positively charging property, and that no fusion is recognized on the blade and the fog density is small.

In the color toners other than those of Example 14 and Comparative 16, particularly, the color toner of Comparative Example 17 wherein a proportion of a releasing agent having a particle diameter of not less than 1.5 μm in the toner is 2% in terms of number, the charging property and transparency are lowered in comparison with the color toners of other Examples and Comparative Examples and, at the same time, fusion was recognized on the blade.

The disclosures of Japanese Patent Application Serial Nos.9-318756 and 9-340288, filed on Nov. 19, 1997 and Dec. 10, 1997, respectively, are incorporated herein by reference.

What is claimed is:

1. A positive charging one-component non-magnetic color toner comprising at least a fixing resin, a coloring agent, a releasing agent and a positive charging electric charge controlling resin, wherein the fixing resin is made of a polyester resin having an acid value of not more than 5 KOHmg/g, a hydroxyl value of not more than 9 KOHmg/g, a weight-average molecular weight of 7000 to 20,000 and a number-average molecular weight of 1,000 to 6,000, and the releasing agent is a polyolefine having an acid value of not more than 10 KOHmg/g and a weight-average molecular weight of 8,000 to 15,000, a proportion of a polyolefine having a particle diameter of not less than 1.5 μm among polyolefines dispersed in the toner being within 1% in terms of the number.

2. The positive charging one-component non-magnetic color toner according to claim 1, wherein the acid value of the modified polyester resin is from 0 to 4 KOHmg/g.

3. The positive charging one-component non-magnetic color toner according to claim 1, wherein the hydroxyl value of the modified polyester resin is from 0 to 7 KOHmg/g.

4. The positive charging one-component non-magnetic color toner according to claim 1, wherein the releasing agent is contained in the amount of 0.1 to 7 parts by weight based on 100 parts by weight of the polyester resin.

5. The positive charging one-component non-magnetic color toner according to claim 1, wherein the acid value of the polyolefine is from 0 to 8 KOHmg/g.

6. The positive charging one-component non-magnetic color toner according to claim 1, wherein the electric charge controlling resin is that having a trialkylammonio group represented by the general formula (6):

(6)

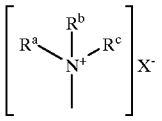

wherein $R^a$, $R^b$ and $R^c$ are the same or different and are an alkyl group such as methyl group, ethyl group, normal propyl group, isopropyl group, normal butyl group, isobutyl group, tertiary butyl group, pentyl group or hexyl group; and $X^-$ is a molybdate ion, a phosphorous molybdate ion, a chromium molybdate ion, a phosphorous tungstate, a tungstate silicide ion, an antimonate ion, a bismuthate ion, a chlorine ion, a bromine ion, an iodine ion, a nitrate ion, a sulfate ion, a perchlorate ion, a periodate ion, a benzoate ion, a naphtholsulfonate ion, a benzenesulfonate ion, a toluenesulfonate ion, a xylenesulfonate ion, a tetraphenylboron ion, a tetrafluoroboron ion, a tetrafluorophosphorous ion or a hexafluorophosphorous ion.

7. The positive charging one-component non-magnetic color toner according to claim 1, wherein the electric charge controlling resin is a styrene-acrylate resin.

8. The positive charging one-component non-magnetic color toner according to claim 1, wherein the amount of the electric charge controlling resin is from 0.5 to 20 parts by weight based on 100 parts by weight of the polyester resin.

9. The positive charging one-component non-magnetic color toner according to claim 1, wherein the coloring agent is at least one selected from the group consisting of black coloring agent, yellow coloring agent, magenta coloring agent and cyane coloring agent.

10. The positive charging one-component non-magnetic color toner according to claim 1, wherein the amount of the coloring agent is from 2 to 10 parts by weight based on 100 parts by weight of the polyester resin.

* * * * *